US005113045A

United States Patent [19]

Crofton

[11] Patent Number: 5,113,045

[45] Date of Patent: May 12, 1992

[54] SAFETY OUTLET

[76] Inventor: Patrick L. Crofton, c/o Aramco, Box 2654, Dhahran 31311, Saudi Arabia

[21] Appl. No.: 686,031

[22] Filed: Apr. 16, 1991

[51] Int. Cl.[5] ..... H01R 33/96; H01R 31/08

[52] U.S. Cl. ..... 200/51.09; 200/51.12; 200/43.05

[58] Field of Search ..... 200/51.09, 51.12, 43.05, 200/43.07, 51.1, 243, 245, 250, 273; 439/188

[56] References Cited

U.S. PATENT DOCUMENTS

| | | | |
|---|---|---|---|
| 2,531,625 | 11/1950 | Hubbell | 200/51.09 |
| 3,370,141 | 2/1968 | Garamszegi | 200/51.09 |
| 4,179,175 | 12/1979 | Farnworth et al. | 200/51.09 |
| 4,230,386 | 10/1980 | Farnworth et al. | 439/188 |

FOREIGN PATENT DOCUMENTS

| | | | |
|---|---|---|---|
| 679124 | 12/1964 | Italy | 200/51.09 |

*Primary Examiner*—Henry J. Recla
*Assistant Examiner*—David J. Walczak
*Attorney, Agent, or Firm*—Harold H. Dutton, Jr.

[57] ABSTRACT

A safety electrical outlet comprising a housing having at least one socket for receiving an electrical plug, the socket comprising at least two openings for receiving the prongs of a plug to be inserted therein, each of the openings having wipers associated therewith for making electrical contact with the prongs of the plug, a plunger associated with each of the openings and positioned behind the associated wiper so that when a plug is inserted into the opening, a prong depresses the plunger causing it to close a switch or contact set for supplying electric current to the wiper and the plug; plungers on both the hot and neutral sidesare in a series circuit in the current supply line so that a prong must be inserted into both openings to close both switches before current is supplied; the plungers are so positioned and configured that if a foreign object is inserted into the opening, it cannot make good physical contact with the plunger and will move off to one side of the plunger without depressing the plunger, so that such an object cannot cause current to be supplied to the wipers.

18 Claims, 2 Drawing Sheets

FIG. 4
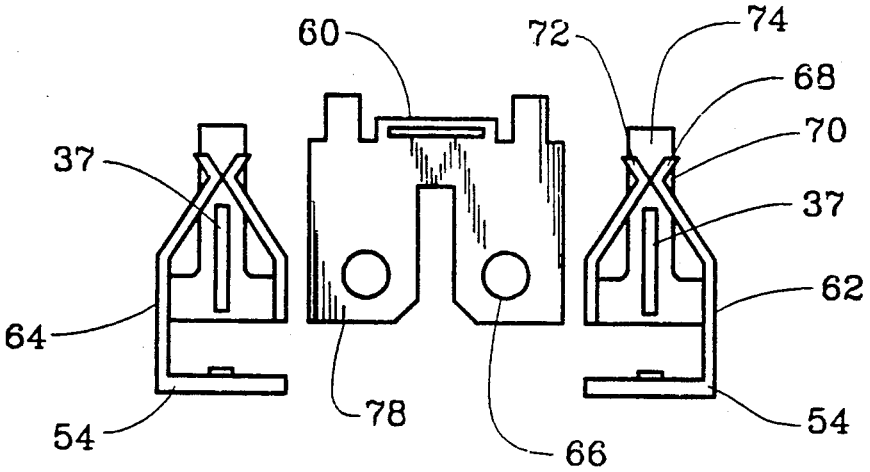
FIG. 5
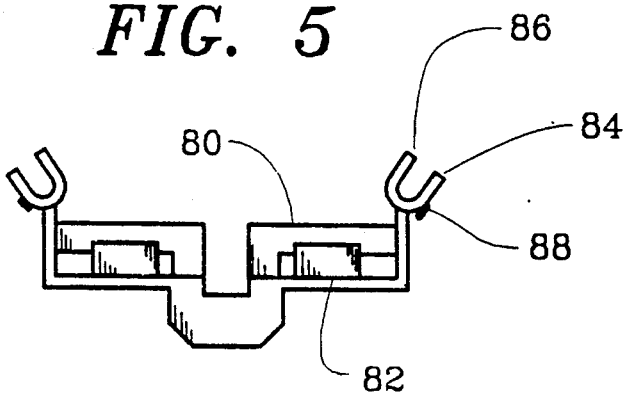
FIG. 6A FIG. 7A
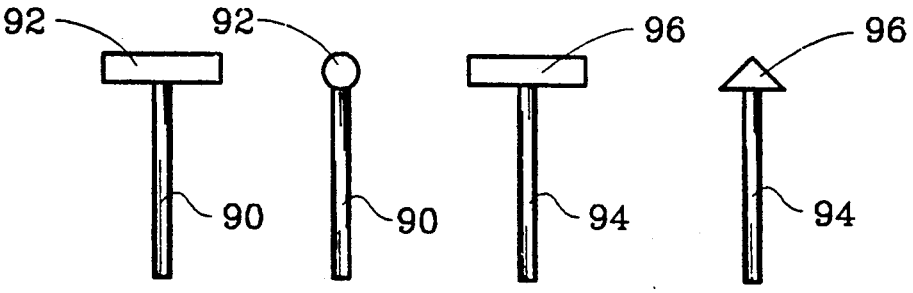
FIG. 6B FIG. 7B

SAFETY OUTLET

This invention relates to a safety outlet for use in conventional residential electrical systems. More particularly, the invention relates to an electrical receptacle which may be used with standard plugs in a conventional manner, but which practically eliminates the possibility of electrical shock from the insertion of other foreign types of objects into the receptacle.

BACKGROUND AND OBJECTS OF THE INVENTION

Many different types of safety outlets have been proposed in the past for use in residential electrical systems, but the prior outlets have all suffered from one or more disadvantages.

One type of outlet proposed in the past used a projecting member integrally mounted on the plug, and which would cooperate with the receptacle to close a contact set, such that in the absence of the projecting member, the contacts would remain open and no current would flow to the object inserted in the receptacle. The disadvantage of this type of receptacle, however, is that it requires modification of each appliance to be used with the receptacle, in order to fit it with an appropriate projecting member to coact with the receptacle. Such a receptacle and plug arrangement is shown in U.S. Pat. No. 3,596,019 to Koester.

Another type of safety receptacle provides one or more pins projecting from the receptacle, so that when a plug is inserted, the body of the plug abuts the pins so as to depress them and close a set of contacts and actuate the flow of current to the inserted plug. One disadvantage of such an arrangement, however, is that the pins are accessible to a child and of course when the pins are depressed, the receptacle is "hot" and the safety aspect is defeated. By recessing the pins, however, the effect of this drawback can be minimized. Such an arrangement is disclosed in U.S. Pat. No. 4,152,557 to Busch, et al.

Still another proposal in the prior art has provided a mechanical see-saw linkage within the receptacle housing. The prongs of the plug are adapted to contact opposite sides of the see-saw thereby depressing the pivot point of the see-saw to close a contact. If only one object (i.e. a nail) is inserted into one of the holes in the receptacle, the see-saw will be unbalanced, such that the pivot point cannot be depressed, and the contacts will not be closed. While such a device would provide advantages, it can only with considerable difficulty be fitted to an outlet having appropriate electrical contacts for conducting the current to the prongs of the plug. Such an arrangement is shown in U.S. Pat. No. 3,617,662 to Miller.

A safety outlet, to be useable, must still meet the needs and demands of the electrical appliance and associated plug with which it is to be used. There must be good electrical contact with the prongs of the plugs which are inserted. A number of prior devices modify existing outlets to such an extent that they no longer provide good electrical connections, and for that reason would not likely be approved by building officials for use in residential applications.

A variety of other devices have been proposed in the prior art, but each has presented its own special drawbacks, with the result that none of the prior art devices is readily available on the market for use. Indeed, the most common type of protective device in use seems to be a simple cap or dummy "plug" made of a dielectric or insulating material, and which is inserted into a conventional (i.e. non-safety type) receptacle when not in use. Because of the shape of the dummy plug, it is difficult for a child to remove it, and of course nothing can be inserted into the receptacle when the dummy plug is in place.

However a significant demand exists for a safety outlet which will effectively prevent the danger of electrical shock to children. For example, when children find and play with electrical outlets, they are used to seeing parents and others inserting something into such outlets, and small children naturally tend to emulate such actions and to put things, i.e. objects such as hairpins, nails, pins, and the like into the holes. Of course too often, they do so with serious injury being the result.

Accordingly a primary object of this invention is to provide a new safety outlet which overcomes the drawbacks of prior art devices.

A further object of the invention is to provide an electrical safety outlet which will minimize the risk of shock to children playinq with the outlet, while still providing good electrical contact, appropriate to meet the requirements of electrical codes, all with no inconvenience to the user.

Another object of the invention is to provide a safety outlet which utilizes a contacting device therein to permit the flow of current to the pins of the plug when inserted, but prevent the flow of current when no plug is inserted in the outlet, or when the plug is partially removed.

Still a further object of the invention is to provide a safety outlet which may be installed in conventional electrical wiring boxes without modification.

Yet a further object of the invention is to provide a safety outlet which may be used in new construction, as well as for replacement outlets in existing installations without modification of the remainder of the electrical system.

Still another object of the invention is to provide an improved safety outlet, which practically eliminates the possibility that a foreign object inserted into the outlet could cause an injury from electric shock.

These and other objects and advantages of this invention will become apparent from the following description of the invention and the description of the preferred embodiments.

SUMMARY OF THE INVENTION

The present invention is intended for use with electrical outlets generally of the duplex type, and uses use an arrangement of contacts and plungers within the outlet in an area in which space exists within the area bounded by the conventional wipers. One arrangement is used with a so-called "triple wipe" arrangement for making the electrical contact with the prongs of a plug. This structure gets its name from the fact that there are three electrical contacts or wipers for the prong of the plug. Two of the wipers are spring biased and opposed so as to contact the two flat faces of the prong when inserted, and the third spring biased wiper is orthogonal to the first two, so as to contact one of the edges of the prong. This is a fairly standard arrangement for modern electrical outlets, and particularly for 15 and 20 amp, 115 volt receptacles. The invention may be used on the hot side alone, but preferably will be used on both the hot and the neutral sides of the outlet. The ground pin is generally rounded, and uses a different wiping arrangement.

The wipers in this manner are arranged as three sides of a rectangle, with the fourth side being open. In the case of only two wipers or contacts, these are typically formed by a U-shaped piece of metal, and still generally have a 'free' space immediately behind and between the contacts, a space which is typically unoccupied, but directly behind the prong of a plug when inserted.

Often, the wipers or contacts of a receptacle are made of a single strip of metal, such as brass, copper, or the like, formed into a configuration so as to complement the shape of the dielectric housing, with the result that a space exists in the housing, between and behind the contacts, and this space is used in the present invention.

According to the invention, a plunger is provided, having typically a T-shape, with the leg of the T extending through a guide member, and with the cross-member portion of the T being positioned in the path of the prong of the plug and transverse to the prong. The guide member may be provided in the space between the wipers or contacts, both on the hot side and on the neutral side of the outlet, with the wipers serving to hold the guide member in place. The plunger may thus move axially (i.e. in the same direction as the prong of the plug which is being inserted) in the space immediately behind the wipers and in so doing is guided by the guide member. The plunger is made of an insulating or dielectric material, typically molded of a plastic of the same type as the non-conducting portions of the outlet or the housing.

The long leg of the 'T' thus forms a projecting portion which extends toward the rear of the outlet. Since the electrical wipers are typically made of a stamped or otherwise formed metal strip bent in such a way as to fit into securing recesses in the housing, the space to the rear of the wipers is not used for the electrical portion of the standard outlet, and the projecting or leg portion will not interfere with the wipers of a conventional outlet. Thus, a hole may be provided in the material forming the housing of the outlet to allow the projecting portion of the plunger to pass through.

In addition, a slot or slots are cut into one or two of the wiper strips, and the top or cross-member portion of the T-shaped plunger travels in these slots when the plunger is depressed so as to keep the plunger from turning or rotating about the long leg thereof, and aligned so that the cross-member is at generally a right angle to the prongs of the plug. In this manner, when a plug is inserted, each of the prongs will contact the crossmember of the respective plunger, depressing the plunger to the extent that the long leg thereof projects to the rear sufficiently to close the contacts or switches, thus supplying current to the wipers in the outlet. On the other hand, if a foreign object such as a nail, hairpin, paperclip, or the like is inserted, the end of that object will slide off of the cross-member portion of the plunger without depressing the plunger.

By providing a slight amount of play in the guide means, the T-shaped plunger may move somewhat freely, but only to a slight extent, thus increasing the likelihood that a foreign object will not depress the plunger, but instead will slide off to one side or another without depressing the plunger.

At the location in which the projecting portion or leg of the T-shaped member emerges from the gear of the dielectric outlet housing, switch members such as a pair of switch contacts are provided. The projecting portion of each of the plungers is arranged so as to close one switch or set of contacts. Both switches or sets of contacts are in a series circuit between the electric current supply (i.e. hot) wire and the wipers for the hot side of the receptacle. With this arrangement of the switches being in series, both switches or sets of contacts must be closed in order to feed electric current to the hot side of the outlet and thus to the plug.

Further, since the two switches are actuated by the hot and the neutral sides of the plug, both prongs of the plug must be inserted completely into the outlet in order for current to be supplied to the hot side of the outlet (and the plug). If a foreign object such as a nail, hairpin, paper clip, etc. is inserted into one of the holes in the face of the outlet, only one of the plungers could possibly be depressed by one object, and no current could flow to the hot side, even if the plunger were to be depressed on that side.

Similarly, in order to depress the plunger, any object, and in particular foreign objects, would have to be inserted beyond the point of mere contact with the wipers, before the wipers are energized with electricity. The spring action of the wipers tends to offer resistance to the insertion of any object into the outlet, and it is at this point that injury usually results, when the foreign object merely contacts the wiper. But with the present invention, a resistance is offered to the further insertion of an object, a resistance which will deter smaller children.

In an alternate arrangement, a third plunger could be provided in such a position as to be contacted by the ground pin of the plug, for actuating a third set of contacts in series with the first two. With such an arrangement, a pin would also have to be inserted into the ground pin hole of the outlet in order for current to be supplied to the plug. This arrangement enables the further feature that only a three pronged plug could be used in the outlet, since if only a two prong plug were used, it would not close the third set of contacts and no current would flow. In this manner, the safety of having a grounded plug cannot defeated by using a plug with the ground prong removed.

The cross-member of the T-shaped plunger may be of a crosssectional shape which helps to prevent a foreign object from making good mechanical contact with and depressing the plunger. Thus, for example, the cross-section may be round, in which case a pointed object will tend to slide off to one side or the other. Another suitable shape would be with a pointed edge directed toward the prongs of a plug. Similarly, an object such as a nail, pin, etc. would slide to one side or the other of the point. In either case, though, since the cross-member is orthogonal to the blade or prong of the plug, the prong will depress the plunger.

DESCRIPTION OF THE DRAWINGS

The invention will be described further with reference to the accompanying drawings showing by way of non-limiting example, one preferred embodiment of the invention, in which:

FIG. 4 is a side elevational view of a typical contact strip of the triple wipe type for use with the present invention;

FIG. 5 is a top plan view of a typical contact strip of the double wipe type for use with the present invention;

FIGS. 6*a* and 6*b* are respectively a plan view and a side elevational view of a plunger for use in the present invention; and FIGS. 7*a* and 7*b* are respectively a plan view and a side elevational view of an alternative embodiment of a plunger for use in the present invention.

DETAILED DESCRIPTION OF PREFERRED EMBODIMENTS

Figure 1:
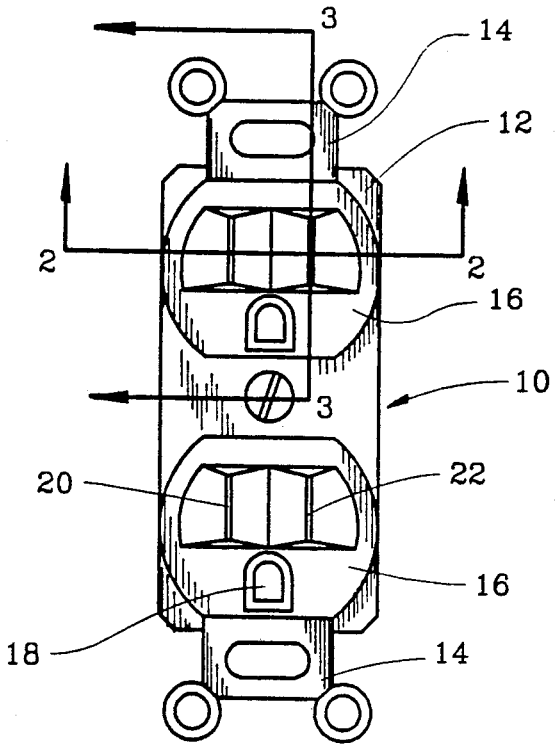
FIG. 1 is a top plan view of a safety outlet according to the invention with no plug inserted therein.

Referring firstly to FIG. 1 of the drawings, a safety outlet according to the invention is generally designated 10, and in this view appears essentially identical to a standard prior art outlet. The outlet 10 is seen to include a housing 12 with mounting tabs 14 along with two electrical receptacles 16. Each receptacle includes a ground prong receiving hole 18, a neutral prong receiving hole 20 and a hot prong receiving hole 22.

Figure 2:
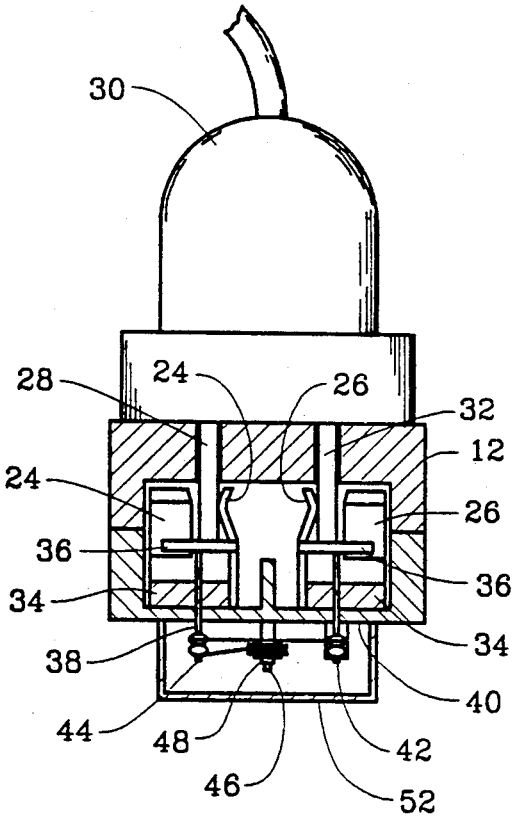
FIG. 2 is an enlarged sectional view of the outlet with a plug inserted and taken along lines 2—2 of FIG. 1 and viewed in the direction of the arrows.
Figure 3:
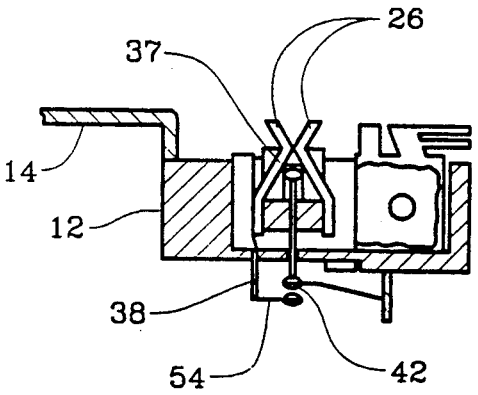
FIG. 3 is an enlarged sectional view along lines 3—3 of FIG. 1 and viewed in the direction of the arrows.

Referring to FIGS. 2 and 3, the housing 12 is made of a dielectric or insulating material, and is seen to house a contact strip having three spring metal wipers or contacts 24 on the neutral side 20, and similar spring metal wipers or contacts 26 on the hot side of the receptacle. The wipers 24 are arranged to contact the neutral prong 28 of a plug 30, while the wipers 26 are so arranged to contact the hot prong 32 of the same plug. The ground prong of the plug is not shown.

Guide members 34 are provided, typically of a rectangular cross-section complementary to that of the space within the wipers 24, 26 of the contact strips. The guide member 34 fits snugly in the space within the wipers and includes an opening passing therethrough for receiving a T-shaped plunger 36. A projecting leg 3 of each plunger extends through the opening in the guide member 34 and through an aperture 40 in the rear of the housing 12. A set of spring biased contacts 42 are positioned directly behind the projection 38 in such a manner that when the plunger is depressed, as when a plug 30 is inserted into the socket, the contacts 42 are moved to a closed position. The T-shaped plunger 36 is positioned in such a manner that the top or short leg of the T is orthogonal or transverse to the prong 28 or 32 of the plug 30, so that the prong 28 or 32 will depress the plunger 36. A slot 37 is provided in one of the wipers of each contact strip, in order that a portion of one of the short, top legs of the plunger 36 will extend into and/or through the slot 37, and thereby prevent the plunger from rotating within the guide member 34. In this manner, the top leg of the plunger 36 will always be perpendicular to the prong of the plug, so that the prong will depress the plunger 36.

However, the shape of the top leg of the plunger 36 is such that an object which is not orthogonal to the plunger 36, i.e. a nail, pin, etc, will slide off to one side or the other, and thus will not be able to depress the plunger and energize the socket. Most simply, a round top edge of the plunger could be used, although in some cases a pointed top edge may be desired.

To further increase the safety, by increasing the likelihood that a foreign object will slide off of the top leg of the plunger, a small amount of free play may be built into the guide member 34 and the slot 37 in the wiper. In this manner, the plunger may move about slightly, i.e. sufficiently to help the foreign object slide off of the top leg of the plunger, preventing depressing of the plunger 36 and energizing of the socket 16.

In this manner, when any object, either the prongs of a plug or a foreign object such as a nail, pin, paper clip, etc., is inserted into the opening 22, for example, the object first touches the contacts 24, but the contacts are not energized yet. Upon continued insertion, the object will then contact the top cross member or leg of plunger 36. An object which is perpendicular to the top leg of the plunger, i.e. the prong of a plug 30, can then depress the plunger, causing the portion 40 to move toward the rear of the housing. At this point, the plunger closes the contacts 42, thus completing that portion of the circuit.

On the other hand, when a foreign object such as a pin or nail contacts the top edge of the cross member of the plunger 36, because of the shape of the top edge, i.e. rounded or pointed, the foregoing object will not be able to depress the plunger but instead will slide off, to one side or the other, and no current will be supplied to the wipers. Thus, the possibility of shock is greatly reduced or eliminated.

To reduce the possibility of shock even further, both prongs of the plug are similarly configured and both the hot and the neutral side of the outlet are similarly configured; however, the wipers 42 and 44 are in series, between the wire 50 supplying current to the fixture (the hot side), and the contacts 26 of the receptacle. In this manner, both contacts 42 and 44 must be closed in order for the contacts 24 to be energized by the current. Thus, unless objects are simultaneously inserted into both the openings 20 and 22, no current can be supplied to the wipers 26, and there is virtually no risk of shock. But, insertion of a conventional plug 30 into the outlet 16 will close both sets of switches or contacts 42, 44, and permit the conduction of current in a conventional manner.

The contacts 42, 44 are shown to be secured in place on a threaded stud 46 by means of a nut 48, and the feed wire 50 may also be secured to this stud 46. A cover 52 may be provided to enclose the contacts 42, 44 if desired. A contact strip 54 completes the circuit to the wipers 26.

FIGS. 4 and 5 show perspective views of typical contact arrangements used in standard duplex receptacles. In FIG. 4, a triple wipe type of contact strip 60 is shown, and includes two mirror image contacts points, 62 and 64, as would each make contact with, for example, the hot prong of a plug. Ordinarily screws (not shown) are threaded into the holes 66 for securing the feed wire(s) to the terminal. In the conventional socket, integrally formed at each end is the triple wiping contactor, which includes wipers 68, 70 and 72. Each of these wipers will contact different portions of one prong of one plug when inserted into the outlet. The conventional wiper strip differs according to the invention to merely by the separation at 78. With this modification, the hot wire may still be attached to the screws in holes 66, but no current is supplied to the wipers except through the contacts and the strip 54 as described above. The slot 37 is provided to guide the travel of the plunger 40 as discussed above.

FIG. 5 shows a conventional double wipe type of contact strip 80, again having holes 82 for screws (not shown) to secure the feed wire in place. The strip 80 is so shaped as to provide a U-shaped contact portion 84 at each end, and the legs 86, 88 of the U form the two contacts, with the prong of the plug passing between the two legs. In this case, a plunger would have its top cross member extending into slots in both of the wipers 86 and 88. Again, the direct connection between the screw terminals and the contactors 86, 88 is to be eliminated by cutting so that current would pass through the contacts on the rear of the housing 12 before reaching the contacts 86, 88.

FIGS. *6a* and *6b* show a plunger 90 similar to the plunger 37, and having a top edge 92 which is rounded. Similarly, FIGS. *7a* and *7b* show another plunger 94, the top edge 96 of which is pointed as seen in FIG. *7b*. As is apparent, such shapes prevent an object, particularly a pointed object, from making adequate contact to be able to depress the plunger and energize the socket. However, when an object having a linear edge perpendicular to the top edge of the plunger contacts the top edge, as when a blade or prong of a plug is inserted into the socket, no difficulty is encountered in depressing the plunger.

In this manner, when the proper object —i.e. a plug—is inserted into the socket, the socket functions normally, but when a foreign object is inserted, no current is likely to flow.

Thus, the invention provides an arrangement which utilizes contacts of rather conventional configuration, with but slight modification, to provide the needed electrical contact, and only slight modification enables the contacts to function to guide the travel of the plungers which make or break contact for energizing or disabling the flow of current.

While this invention has been described as having certain preferred features and embodiments, it will be understood that it is capable of still further variation and modification without departing from the spirit of the invention, and this application is intended to cover any and all variations, modifications and adaptations of the invention as may fall within the spirit of the invention and the scope of the appended claims.

I claim:

1. A safety electrical outlet comprising a housing formed of an insulating material and at least one socket for receiving an electrical plug having prongs for making electrical contact, said socket comprising at least two openings adapted to receive the prongs of the plug, and each of said openings having wipers means for making electrical contact with one of the prongs, said wiper means each comprising a metal contactor strip and defining a channel portion, a plunger member having a T-shaped configuration associated with each of said openings and adapted to e contacted by one of the prongs of a plug and to move in response to contact by a prong, means for independent guiding movement for each of said plunger members, said plunger member each having a leg portion extending toward the rear of said housing and a top portion having a major dimension essentially transverse to said openings and to the prong of a plug contact means positioned so as to be actuatable by said leg portion when said plunger member is moved by a prong of a plug, said contact means being in series connection with means for conducting electric current to one of said wiper means, whereby the prongs of the lug depress each of said plunger members for closing each of said contact means and supplying electric current to said wiper means upon insertion of a plug into said outlet, and preventing supply of current to aid outlet upon insertion of a different object into said receptacle.

2. A safety electrical outlet as in claim 1 and wherein said contact means are mounted on the rear of said housing behind each of said openings.

3. A safety electrical outlet as in claim 2 and wherein said plunger members project to the rear of said housing when depressed and are retracted within said housing until depressed.

4. A safety electrical outlet as in claim 1 and wherein the leg portion of said plunger travels in a guide member.

5. A safety electrical outlet as in claim 4 and wherein said guide member is positioned in said channel portion of said wiper means.

6. A safety electrical outlet as in claim 1 and including means for guiding said top portion of said plunger to prevent said plunger from rotating.

7. A safety electrical outlet as in claim 6 and wherein said plungers have a T-shaped configuration.

8. A safety outlet as in claim 7 and including a slot formed in said wiper means, and said top portion of said plunger means being constrained to travel in said slot.

9. A safety electrical outlet as in claim 2 and including a cover for enclosing said contacts.

10. A safety electrical outlet as in claim 1 and wherein said plungers are made of a dielectric or insulating material.

11. A safety electrical outlet for use with electrical plugs having prongs for contacting hot and neutral wipers, the outlet comprising a housing, a first hot wiper and a second neutral wiper, plunger members associated with each of said wipers and guided thereby, said plunger members including a leg portion and a top portion and being positioned so that said top portion is substantially normal to and moved by a prong of an electrical plug inserted into said outlet, a pair of switch members in a series circuit between electric current supply means and said first wiper, the leg portion of each of said plunger members projecting from said housing for actuating one of said switch members and thereby supplying electric current to said first wiper when a plug having two prongs is inserted into said outlet.

12. A safety electrical outlet as in claim 10 and including means preventing rotation of said plunger members.

13. A safety electrical outlet as in claim 11 and wherein said outlet is a duplex receptacle.

14. A safety electrical outlet as in claim 11 and including means guiding the movement travel of said plunger members.

15. A safety electrical outlet as in claim 13 and wherein said plunger members are T-shaped so as to have leg portions and perpendicular top portions said leg portions contacting said switch members.

16. A safety electrical outlet as in claim 14 and wherein said top portions of said plunger members have a round surface facing said prongs, whereby a pointed object contacting said top portion will tend to slide to one side thereof.

17. A safety electrical outlet as in claim 14 and wherein said top portions of said plunger members have a pointed surface facing said prongs, whereby a pointed object contacting said top portion will tend to slide to one side thereof.

18. A safety electrical outlet as in claim 14 and wherein said plunger members are loose fitting in said guiding means.

* * * * *